United States Patent [19]

Frate

[11] Patent Number: 5,050,869

[45] Date of Patent: Sep. 24, 1991

[54] PORTABLE EXERCISE MACHINE

[76] Inventor: Richard A. Frate, 250 Hillsboro Rd., N.W., Orangeburg, S.C. 29115

[21] Appl. No.: 534,550

[22] Filed: Jun. 7, 1990

[51] Int. Cl.[5] ..... A63B 21/06

[52] U.S. Cl. ..... 272/117; 272/900

[58] Field of Search ..... 272/900, 117, 118

[56] References Cited

U.S. PATENT DOCUMENTS

| | | | |
|---|---|---|---|
| 4,109,907 | 8/1978 | Zito | 272/900 |
| 4,225,130 | 9/1980 | Zimmerman | 272/900 |
| 4,316,609 | 2/1982 | Silberman | 272/117 |
| 4,844,448 | 7/1989 | Niznik | 272/900 |

FOREIGN PATENT DOCUMENTS

| | | | |
|---|---|---|---|
| 3640480 | 6/1988 | Fed. Rep. of Germany | 272/117 |

*Primary Examiner*—Richard J. Apley
*Assistant Examiner*—Karen G. Horowitz
*Attorney, Agent, or Firm*—B. Craig Killough

[57] ABSTRACT

An exercise unit or weight machine which may be mounted to a door frame for use. The device is designed for portability in that the unit may be quickly mounted to the door frame and dismounted therefrom, and is symmetric so as to allow the device to be used on either side of the door frame.

9 Claims, 2 Drawing Sheets

PORTABLE EXERCISE MACHINE

BACKGROUND OF THE INVENTION

The present invention relates to an exercising apparatus as more particularly directed to an apparatus which is transportable and which may be mounted in a doorway to provide for weight lifting and exercising.

Weight lifting is a well known means of body building as well as exercising. The use of weights attached to a system of cables and pulleys is known, and has been used as an alternative to the use of free weights alone. The use of such a cable and pulley system allows for weights to be easily added or subtracted so that the desired amount of weight can be changed according to the desire of the user, and according to the particular exercise being performed. Such systems allow an extensive list of exercises to be performed.

Since, in many situations, the use of a permanent, free standing cable and pulley exercising system is not desirable, the present invention provides a system which may be quickly and easily mounted to a wall at a door frame. Many homes do not have a room to which a free standing exercise machine can be dedicated. Likewise, the user may desire to exercise while traveling, and such free standing units cannot be easily transported.

SUMMARY OF THE INVENTION

The present invention provides a cable and pulley exercising unit which may be easily mounted to the wall, used, and then dismounted from the wall. The device therefore allows for easy storage, eliminating the need to dedicate a room or part of a room within a home to an exercise unit. The assembly is light enough and transportable enough that it ma be conveniently transported by the user. The device will mount to any wall at or near a door frame, meaning that the device can be used in virtually any dwelling, including homes, offices, and hotel or motel rooms.

The device incorporates, at a minimum, a high and a low pulley. Free weights may be attached to the pulleys as desired according to the strength of the user, the exercise to be performed, and the exercise routine desired. Likewise, different handles may be mounted to the opposite end of the cable from the weights to vary the exercise routine.

The device takes advantage of the construction of door frames to provide the structural integrity necessary to support such a device. The apparatus mounts on a wall just behind the door frame itself, and on the opposite side of the door frame from the door opening. Door frames are constructed so that additional wall studs are present in this area, meaning that the mounting pads which the device uses can be safely attached to the wall giving sufficient strength for the exercise routine, without damage to the wall.

DETAILED DESCRIPTION OF THE DRAWINGS

Figure 2:
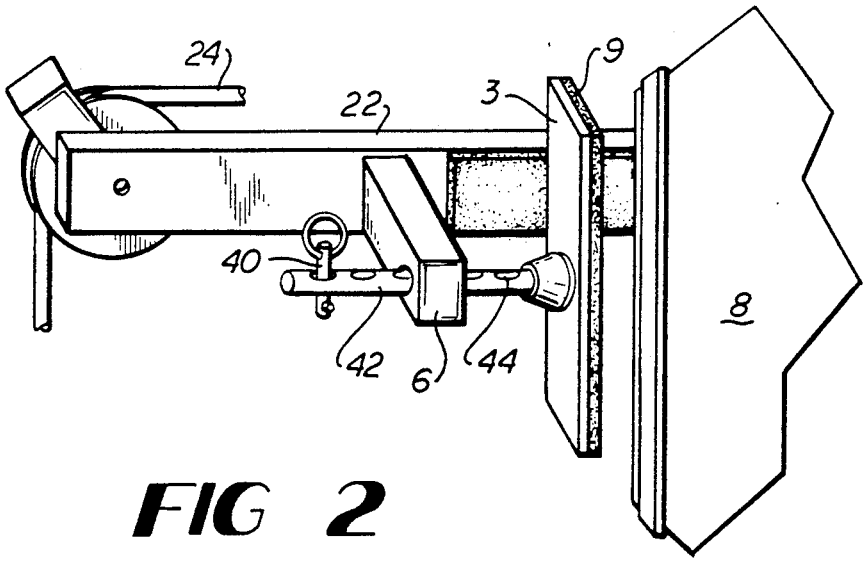
FIG. 2 is an isolation of the upper mounting assembly, showing pad 3 in an open position with a pull pin which allows finite adjustment of the pad.
Figure 3:
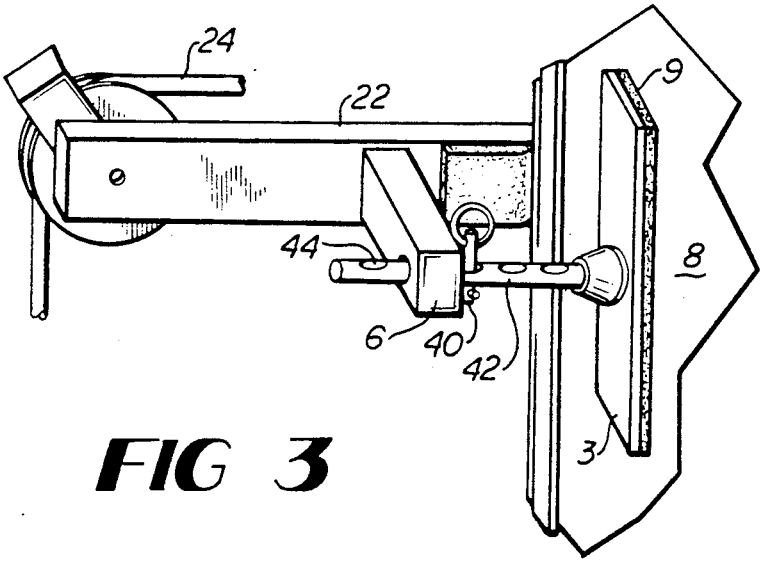
FIG. 3 is substantially the same view as FIG. 2, with pad 3 repositioned from FIG. 2 by means of the pull pin to tighten the pad against the wall.
Figure 4:
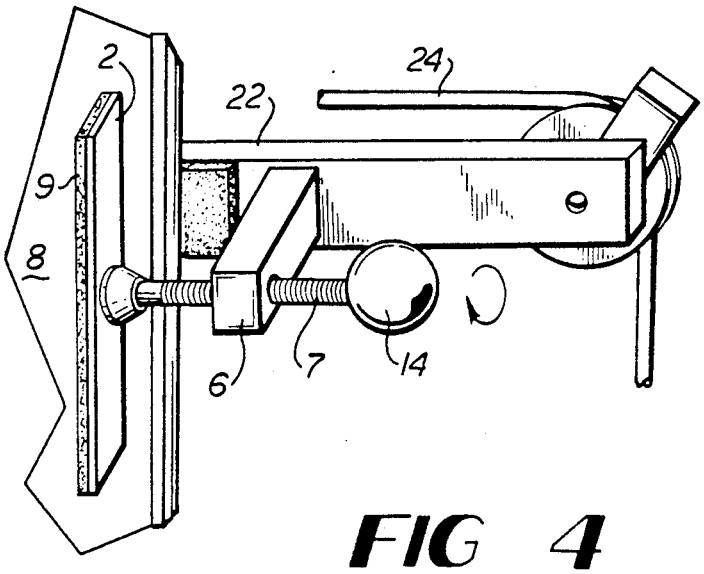

FIG. 4 is an isolation of the upper mounting assembly showing pad 2 which is opposite pad 3 of FIGS. 2 and 3.

DETAILED DESCRIPTION OF THE PREFERRED EMBODIMENT

The preferred embodiment of the portable exercise unit uses an upper pair of mounting pads 2, 3 and a lower pair of mounting pads 4, 5. These mounting pads mount the device to the wall 8 adjacent to the door frame 10. The tightening means 7 is used to apply pressure to the pads 4, 2, which in turn applies pressure to the wall so as to hold the apparatus in place. At least an upper and lower pair of pads should be used, however, additional pads could be used if desired.

It is preferred that the pads contact the wall 8 so that the door frame is between the door opening and the pads, with the longitudinal member 12 being located in the doorway. By locating the pads on the wall adjacent to the door frame, but opposite the opening of the door frame, the pads take advantage of the structure of most door frames so as to give the device sufficient rigidity and strength while in use. Door frames will usually have studs or similar structural members present at the door frame, which will give the device sufficient strength while not damaging the wall or the door frame. Further, by locating the pads adjacent to the door frame itself, the door frame aids the pads in holding the frame of the exercise unit motionless while in use.

Various means may be used for tightening the pads against the wall, including a cam type means, or threaded means. Threaded means 7 as shown in FIG. 3 allows for tightening of one of the pads 2, 4 against the wall 8. The remaining pad of the pair of pads is fixed, or may be capable of limited adjustment. In the preferred embodiment as shown in FIGS. 2 and 3, a pull pin is used to allow for finite adjustment of pads 3, 5. Since the device is portable, it is preferred that the threaded means be given an handle 14 which will allow the unit to be manually fixed in place, without the need of tools. Rubber, foam or other resilient material 9 may be attached to a surface of said pads which contact the wall to increase adhesion and to protect the wall.

The upper pair of pads 2, 3 is joined to the lower pair of pads 4, 5 by a longitudinal member 12. This longitudinal member is capable of height (length) adjustment. In the preferred embodiment, the longitudinal member is two pieces 12*a*, 12*b*, with one piece 12*b* sliding within the other piece 12*a*. An adjustment means 16 is provided, which may be a threaded locking means, or could be a series of voids drilled through one of the members, through which a pin is placed so as to selectively shorten or lengthen the longitudinal member. Any other known means for lengthening and shortening the longitudinal member could be used, so long as the longitudinal member may be statically positioned against the wall.

A series of pulleys 18 is provided and attached to the frame of the device. In the preferred embodiment, an upper horizontal member 22 is affixed to the longitudinal member 12, and a pulley 18 is affixed to each end thereof. A cable 24 is then provided which is run through each of the pulleys 18, and a handle 26 is attached to one end of the cable, and weights 28 are attached to the opposite end. Various configurations of handles may be used, and accordingly, a quick release means 30 should be provided for changing handles Either an S hook or a snap shackle or other similar means could be provided for attaching the handles. Likewise, a quick release means 32 should be provided for changing weights, or a means should be provided for attaching additional weight to the end of the cable opposite the handle.

Figure 1:
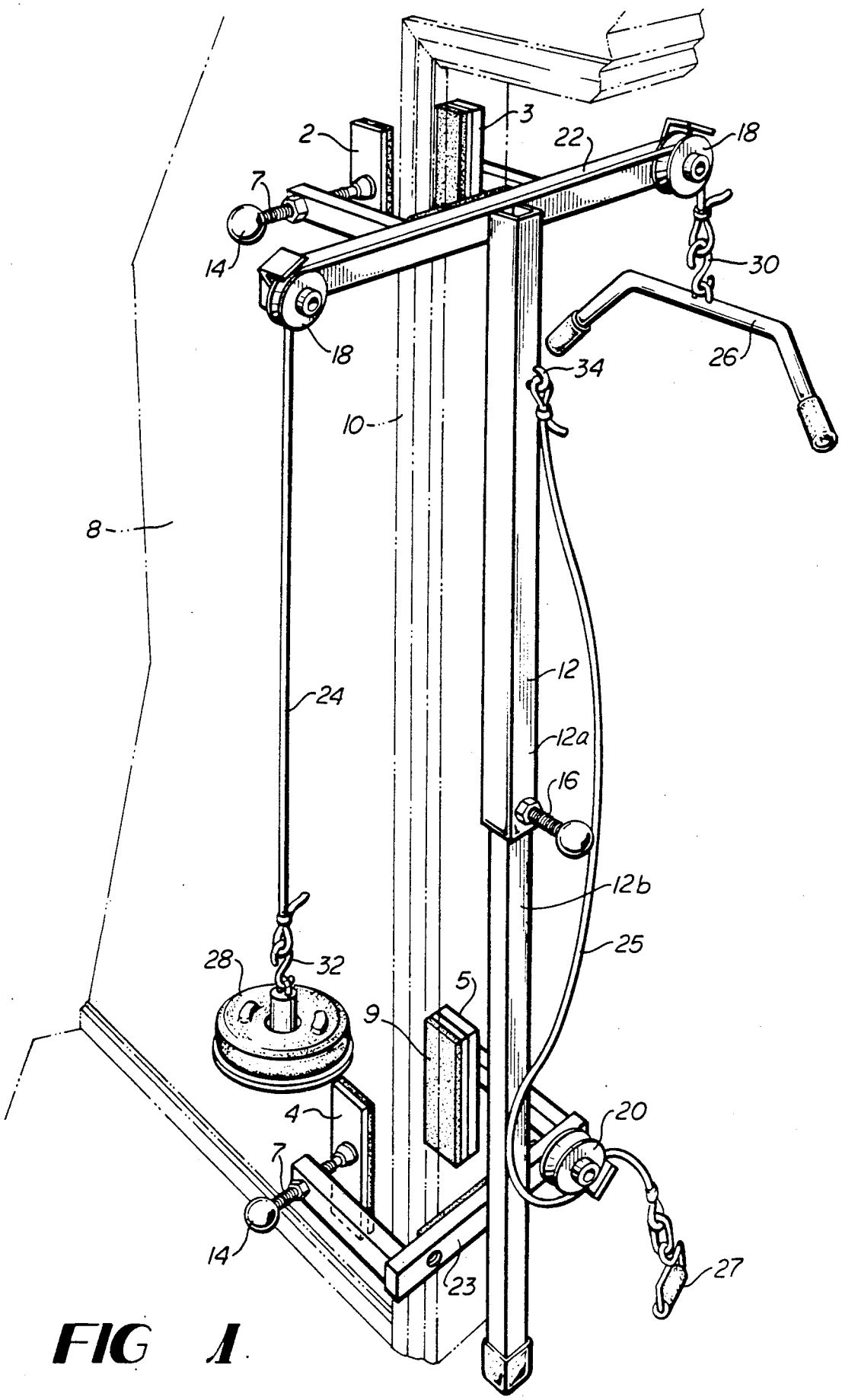
FIG. 1 is a perspective view of the portable exercise machine mounted onto a door frame.

At least one additional pulley 20 may be mounted to the frame of the device. In the preferred embodiment, this pulley is attached to the lower part of the frame, on a second horizontal member 23 which may be shorter than the first member. A cable 25 may have a handle attached to one end thereof, and a weight attached to the opposite end. As shown in FIG. 1, one end of the cable 25 which is not in use may be placed out of the way on a hook 34. When in use, the end of the lower cable 25 opposite the handle 27 is attached to the end of cable 24 opposite the weight.

FIGS. 2, 3, and 4 show the operation of the mounting pads. Specifically, the mounting pad 2 which is capable of tightening against a wall is shown being actuated by a threaded means 7. The handle 14 is rotated so as to operate the threads and move the pad 2 toward the wall 8, and is rotated until the pad applies sufficient pressure to the wall to hold the device.

Mounting pads 3 and 5 may be fixed, or capable of infinite adjustment within a limited range, such as be the use of the threaded means used with pad 2 and shown in FIG. 4. However, in the preferred embodiment, a finite adjustment means is used which allows the pad to be repositioned quickly. The finite adjustment means as shown in FIG. 2 and 3 is a pull pin 40 which may inserted into void 44 and shaft 42.

By use of the tightening means shown in FIGS. 2, 3, and 4, the device may be quickly but securely fastened to the wall. Pad 2 may be opened by rotating threaded tightening means. Pad 3 may then be pushed against the wall, and the pull pin inserted into a void which is between pad 3 and mounting arm 6, but which is closest to mounting arm 6. The device is fully secured to the wall by rotating handle 14 in an opposite direction so as to tighten pad 2 against the wall by the threaded tightening means.

The symmetrical design of the device allows it to be located on either side of a door frame. The lower pulley and the weight stack may be moved from side to side as needed so as to allow mounting of the device on either side of the door frame. Accordingly, the device may be mounted to almost any door frame.

What is claimed is:

1. A portable exercise unit which may be mounted to a door frame, comprising:

a. two or more of pairs of pads, in a vertical array in which at least one of each of said pair of pads may be adjustably moved toward the other so as to apply pressure to a wall adjacent to a door frame;

b. a member which connects said pairs of pads;

c. one or more pulleys mounted to said member; and e. one or more cables running through said pulleys, and having weights attached at one end.

2. A portable exercise unit as described in claim 1, wherein one or both of each pair of said pads may be continuously adjusted over a predetermined length so as to allow said pad to be moved toward a remaining pad, and apply pressure to a said wall.

3. A portable exercise unit as described in claim 1, wherein one pad of each pair of said pads is capable of incremental adjustment, and a remaining pad of each of said pair of pads is capable of continuous adjustment along a predetermined length thereof so as to allow said pads to be moved toward each other and to apply pressure to a said wall.

4. A portable exercise unit which may be mounted to a door frame, comprising:

a. a first upper pair of pads one or both of which may be adjustably moved toward each other so as to apply pressure to a wall and opposite an opening to a door frame;

b. a lower pair of pads at least one of which may be adjustably moved toward the other so as to apply pressure to a wall and opposite an opening to a door frame;

c. a longitudinal member which connects said upper pair of pads with said lower pair of pads;

d. one or more pulleys mounted to said longitudinal member; and e. one or more cables running through said one or more pulleys, and having one or more weights attached thereto.

5. A portable exercise unit as described in claim 4, wherein said longitudinal member may be lengthened or shortened.

6. A portable exercise unit as described in claim 5, wherein one or both of each pair of said pads may be continuously adjusted over a predetermined length so as to allow said pad to be moved toward a remaining pad, and apply pressure to a said wall.

7. A portable exercise unit as described in claim 5, wherein one pad of each pair of said pads is capable of incremental adjustment, and a remaining pad of each of said pair of pads is capable of continuous adjustment along a predetermined length thereof so as to allow said pads to be moved toward each other and to apply pressure to a said wall.

8. A portable exercise unit as described in claim 4, wherein one or both of each pair of said pads may be continuously adjusted over a predetermined length so as to allow said pad to be moved toward a remaining pad, and apply pressure to a said wall.

9. A portable exercise unit as described in claim 4, wherein one pad of each pair of said pads is capable of incremental adjustment, and a remaining pad of each of said pair of pads is capable of continuous adjustment along a predetermined length thereof so as to allow said pads to be moved toward each other and to apply pressure to a said wall.

* * * * *